United States Patent [19]

Ema et al.

[11] 4,191,568

[45] Mar. 4, 1980

[54] PHOTOSENSITIVE MATERIAL FOR ELECTROPHOTOGRAPHY WITH DYE CONTAINING OVERLAYER

[75] Inventors: Hideaki Ema, Sagamihara; Satoshi Otomura, Chiba; Chikara Imai; Kiyoshi Sakai, both of Tokyo, all of Japan

[73] Assignee: Ricoh Co., Ltd., Tokyo, Japan

[21] Appl. No.: 884,836

[22] Filed: Mar. 9, 1978

[30] Foreign Application Priority Data

Mar. 15, 1977 [JP] Japan ..... 52-28260

[51] Int. Cl.[2] ..... G03G 5/14

[52] U.S. Cl. ..... 430/66

[58] Field of Search ..... 96/1.5, 1.5 N, 1.6

[56] References Cited

U.S. PATENT DOCUMENTS

| | | | |
|---|---|---|---|
| 3,394,001 | 7/1968 | Makino | 96/1.5 R |
| 3,438,773 | 4/1969 | Hayashi et al. | 96/1.5 N |
| 3,532,496 | 10/1970 | Chiang et al. | 96/1.5 R X |
| 3,840,368 | 10/1974 | Ikeda et al. | 96/1.6 |
| 3,955,978 | 5/1976 | Rochlitz et al. | 96/1.5 |
| 3,982,937 | 9/1976 | Wiedemann | 96/1.5 R |

FOREIGN PATENT DOCUMENTS

| | | | |
|---|---|---|---|
| 50-14524 | 5/1975 | Japan | 96/1.6 |

*Primary Examiner*—Roland E. Martin, Jr.

*Attorney, Agent, or Firm*—Blanchard, Flynn, Thiel, Boutell & Tanis

[57] ABSTRACT

A photosensitive material for use in electrophotography is disclosed which comprises a conductive support, a photoconductive layer superposed on said support and a protective layer superposed on said photoconductive layer, said surface protective layer containing an organic compound which has a structure according to the formula

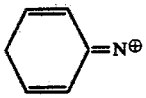

in a part of the molecule.

10 Claims, No Drawings

PHOTOSENSITIVE MATERIAL FOR ELECTROPHOTOGRAPHY WITH DYE CONTAINING OVERLAYER

BACKGROUND OF THE INVENTION (1) Field of the Invention:

The present invention relates to an electrophotographic photosensitive material and more particularly to an electrophotographic photosensitive material which is devised to permit the production of a high quality image by incorporating a specified organic compound in a surface protective layer.

(2) Description of the Prior Art:

Various electrophotographic photosensitive materials have hithereto been well known in the electrophotographic art, for instance, the so-called binder type electrophotographic photosensitive material which comprises coating the surface of a conductive support with a solution obtained by dispersing an inorganic photoconductive substance such as zinc oxide, titanium oxide or the like in a binder (binder resin), and an electrophotographic photosensitive material which comprises depositing on a conductive support an organic photoconductive substance such as poly-N-vinyl carbazole or the like.

These electrophotographic photosensitive materials (which hereinafter will be called "photosensitive material" in short) have at present been considerably improved to such an extent that they can produce high quality copies when developed using a toner composed mainly of a coloring pigment such as carbon black or the like or a magnetic substance and a resin.

By the way, the aforesaid photosensitive materials include a type which comprises further forming a protective layer on a photocondutive layer. This protective layer is provided mainly for the purpose of protecting the photoconductive layer. However, the protective layer-provided photosensitive material of this sort has a tendency that the background is easily stained and copies of poor sensitivity are liable to be produced. Presumedly, this takes place due to the electrically insulating property of the protective layer.

It is of course known as a solution to this problem to add a substance having a superior ability to accept an electric charge to a protective layer for the purpose of preventing the occurrence of residual charge. As the additives used herein there can be enumerated carbon black, metal powder, tetra-ammonium salt and so forth.

However, when these additives are contained in a protective layer, it brings about the effect of promoting the conductivity of the protective layer and thus preventing the accumulation of electric charge, whilst it entails a disadvantageous effect on the protective layer, that is, the ability to retain an electric charge in the dark is deteriorated, said ability being an indispensable requisite in the field of electrophotography. It is, in effect, extremely difficult to find an amount of the additive which can prevent the accumulation of electric charge as well as promote the ability to retain an electric charge in the dark simultaneously.

Furthermore, Japanese Laid-open Patent Application No. 3992/1975 (the basic application P-2336094.3 was filed in West Germany by Hoechst Company) discloses a recording material for use in electrophotography which comprises forming on an amorphous selenic photoconductive layer an overcoating layer containing a dialkylamino radical-substituted heterocyclic electron donor and if needed, a sensitizer, i.e., a dyestuff of any kind, thereby promoting the transfer of the electric charge generated on said photoconductive layer. However, when reproduction is repeated using this recording material, it gives rise to a residual potential owing to light-fatigue, thereby hampering the production of satisfactory images.

SUMMARY OF THE INVENTION

One object of the present invention is to provide an electrographic photosensitive material capable of eliminating the aforesaid drawbacks of prior art photosensitive materials and always permitting the production of a multiplicity of clear, distinct copies, which material is of the type that has a protective layer on the surface thereof.

Another object of the present invention is to provide a photosensitive material for use in electrophotography which gives rise to little residual potential owing to light-fatigue even when reproduction is conducted repeatedly.

A further object of the present invention is to provide a photosensitive material for use in electrophotography which can be easily prepared without employing a complicated manufacturing process.

The present inventors have hitherto carried out a series of investigations and studies on electrophotographic photosensitive materials in order to achieve the aforesaid objects, and consequently have discovered that the incorporation of a specific organic compound, as the additive, in a protective layer is effective in preventing the occurrence of residual electric charge without deteriorating the ability to retain an electric charge in the dark, said specific organic compound having a structure according to the formula

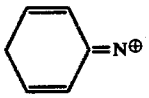

in a part of the molecule. The present invention has been accomplished on the basis of this discovery. In the accordance with the present invention, there is provided an electrophotographic photosensitive material comprising a conductive support, a photoconductive layer superposed on said support and protective layer superposed on said photoconductive layer, wherein said protective layer contains an organic compound having a structure according to the formula

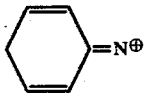

in the molecule. This specific organic compound (organic compound having a structure according to the formula

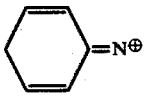

in the molecule) includes, for instance, Rhodamine B, Rhodamine 6G, Rhodamine 110, Rhodamine B Lake, Rhodamine 6G Lake, Rhodamine 6G Perchloride, Sulpho Rhodamine B, Crystal Violet, ethyl violet, methyl violet, Brilliant Green, Malachite Green oxalate, Pyronine B, Diamond Green, Malachite Green and so forth. These compounds may be used either singly or in combination of two or more compounds. However, the amount thereof in the protective layer should be in the range of from about 0.1 to 30% by weight, preferably about 1 to 10% by weight.

The principal ones of the above-recited organic compounds will be represented by scientific names hereinafter:

Rhodamine B is tetraethyldiamino-o-carboxy-phenyl-xanthenyl chloride. Rhodamine 6G is ethyl ester of diethyldiamino-o-carboxy-phenyl-xanthenyl chloride. Sulpho Rhodamine B (MLB) is sodium salt of tetraethyldiamino-sulpho-phenyl-xanthenyl sulphonate. Crystal Violet is tetramethyldiamino-fuchson-dimethylimonium chloride. Ethyl Violet is tetraethyldiamino-fuchson-diethylimonium chloride. Pyronine B is tetraethyldiamino-xanthenyl chloride. Rhodamine B Lake is phospho-12-tungstate-molybdate of diethyl-m-amino-phenyl-phthalein. Rhodamine 6G Lake is phospho-12-tungstate-molybdate of ethyl ester of diethyldiamino-o-carboxy-phenyl-xanthenyl chloride. Malacite Green oxalate is oxalate of the following structure

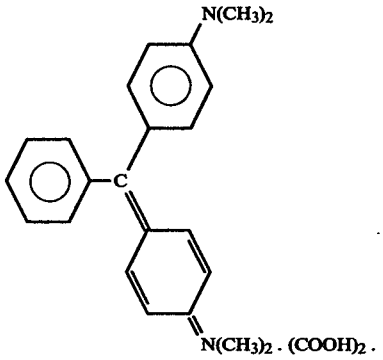

Methyl Violet is trimethyl-diamino-fuchson-dimethylimonium chloride. Brilliant Green is diethylamino-fuchson-diethylimonium sulphate. Malachite Green is dimethylamino-fuchson-dimethylimonium choride. And Malachite Green NJ (oxalate) is oxalate of p,p'-tetramethyldiamino-triphenylcarbino-anhydride.

As for the resin used in the protective layer of the photosensitive material according to the present invention, any resin is available which can be employed in the field of this art. Exemplifying some of them, there can be enumerated polystyrene, acrylic resin, vinyl chloride-vinyl acetate copolymerized resin, polyurethane resin, cellulose resin, etc. The thickness of the protective layer suitably is in the range of about 0.5 to 5 μm.

In actually preparing the photosensitive material according to the present invention, a conventional procedure may be employed which comprises forming a photoconductive layer on a conductive support, applying a solution onto said photoconductive layer with a doctor blade or the like, said solution being prepared by dissolving or dispersing a resin for the formation of a protective layer and an organic compound such as aforesaid Rhodamine B or the like in a suitable solvent, and drying the same at a temperature ranging from about 40° to 130° C. to thereby provide a protective layer. In carrying out this procedure it will do that a necessary amount of a catalyst such as cobalt naphthenate, lead naphthenate or the like has been contained in the protective layer.

The conductive supports suitably used in the present invention include, for instance metal plates such as Al, Cu, Pb and the like, plates made of metallic compounds such as $SnO_2$, CuI, $CrO_2$ and the like, plastic films, a glass plate, paper and so forth deposited with the foregoing metals or metallic compounds on the surfaces through evaporation or sputtering.

Moreover, a plasticizer may be concurrently used in the protective layer. As the plasticizers there may be employed those per se which have usually been used as the plasticizer for resins such as dibutyl phthalate, dioctyl phthalate and so forth. The amount of plasticizer used is suitably in the range of from about 5 to 30 parts by weight relative to 100 parts by weight of resin for use in the formation of the protective layer.

The photosensitive material thus prepared makes it possible to exhibit an extremely high image density in comparison with the conventional protective layered-photosensitive materials.

In addition thereto, it has been recognized that the use of the aforesaid specific additive (specific organic compound) together with an electron acceptor material having a high electron affinity permits the preparation of an electrophotographic photosensitive material capable of maintaining the ability of retaining an electric charge in the dark to a sufficient degree even under the high temperature conditions, in other words, an electrophotographic photosensitive material which comprises conductive support, a photoconductive layer superposed on said support and a protective layer superposed on said photoconductive layer, characterized in that said protective layer contains an organic compound having a structure represented by the formula

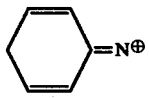

in the molecule and an electron acceptor material. Especially in the case of the presciption like this, it is desirable that the electron acceptor material should have an electron affinity value of more than about 1.0 eV.

The electron acceptor substance suitably employed in the present invention includes, for instance, 7,7,8,8-tetracyanoquinodimethane, tetracyanoethylene, 2,4,7-trinitrofluorenone, o-chloroanil, 2,5-dichloro-p-benzoquinone, 2,3-dichloro-5,6-dicyano-p-benzoquinone, 2,6-dicyano-p-benzoquinone, tetracyano-p-benzoquinodimethane, o-bromanil, p-chloranil, trichloro-p-benzoquinone, 2,6-dichloro-p-benzoquinone, 2,5-dichloro-p-benzoquinone, 2,3-dichloro-p-benzoquinone and so forth. These substances may be employed either singly or in combination of two or more substances but the amount thereof in the protective layer should be in the range of from about 0.1 to 30% by weight, preferably from about 1 to 10% by weight.

The addition of the aforegoing electron acceptor substance alone to the protective layer can surely improve, to some extent, the ability to retain an electric charge in the dark under the high humidity conditions, but can not dissipate the residual electric charge.

However, when this electron acceptor substance is added to the protective layer together with an organic compound having a structure according to the formula

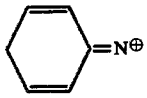

in a part of the molecule the residual electric charge can be dissipated and the ability to retain an electric charge in the dark can be maintained under the conditions inclusive of high humidity. The detailed investigations have not been carried out into the reason why such effects are brought about, but it is presumed that the aforesaid specific organic compound having an electron donation-like property cooperates with the said electron acceptor substance, thereby bringing the electric charge into a desirable condition.

In this connection it is mentioned that the photosensitive material according to the present invention which comprises the concurrent use of said electron acceptor substance and specific organic compound may be prepared in accordance with the aforesaid process for making photosensitive materials.

DESCRIPTION OF THE PREFERRED EMBODIMENTS

EXAMPLE 1

(Preparation of Photosensitive Layer A)

A thousand grams of activated photoconductive tempered cadmium fine powder were dispersed in 1000 grams of a 10% methylethylketone solution of an epoxy resin (manufactured by Shell Oil Company, trade name: Epikote 828) by means of a homogenizer. To the same were added 30 grams of a polyamide hardening agent (manufactured by General Mills Company, trade name: Versamide 115). Thereafter, the resulting solution was applied, by dipping, onto a 0.2 mm-thick aluminum plate to give a dry film thickness of about 50 microns, and dried with a hot wind of 120° C. for 30 minutes.

(Preparation of Photosensitive Layer B)

Selenium with the purity of 99.999% was heated and evaporated at a temperature ranging from 250° to 350° C. and in a vacuum of $10^{-4}$ to $10^{-6}$ torr, and the same was deposited, through evaporation, on an aluminum plate (0.2 mm-thick) heated to a temperature of 60° C. to give an about 50μ-thick film.

(Preparation of Photosensitive Layer C)

A solution with various compositions as follows was prepared.

| | |
|---|---|
| Luvican M-170 (Poly-N-vinylcarbazole, manufactured by BASF Company) | 40 g |
| 2,4,7-trinitrofluorenone | 66 g |
| Polyester adhesive 49000 (Thermo-plastic polyester, manufactured by DuPont Company) | 9.4 g |
| Tetrahydrofuran | 740 g |

The thus prepared solution was applied, with a blade, onto a polyester film (47μin thickness) deposited with aluminum by means of vacuum evaporation to give a dry film thickness of about 12μ, and the same was dried at 60° C. for 10 minutes followed by additional drying at 110° C. for 3 minutes.

On the other hand, the following No. 1 to No. 8 compositions for the preparation of solutions for use in coating protective layers were respectively put in a ball mill having a standard capacity of 200l together with about 800 grams of stainless steel balls, each having a diameter of 0.94 mm, and milled at a revolving speed of 94 rpm for 72 hours. In this connection it is mentioned that in the case of No. 3 only mixed and stirring were operated with the exception of ball-milling.

| | | |
|---|---|---|
| No. 1 | | |
| | HSP (Cellulose acetate propionate having a 0.5 second viscosity manufactured by Eastman Kodak Company) | 400 g |
| | Crystal Violet | 32 g |
| | Tetrahydrofuran | 2400 g |
| | N,N-dimethylformamide | 1200 g |
| No. 2 | | |
| | Paraprene pellet 27 SM (Thermo-plastic polyurethane elastomer manufactured by Nihon Polyurethane Company) | 400 g |
| | Brilliant Green | 1.0 g |
| | Tetrahydrofuran | 2400 g |
| | N,N-dimethylformamide | 1200 g |
| No. 3 | | |
| | U Polymer (Thermo-plastic aromatic polyester manufactured by UNITIKA Company) | 200 g |
| | Rhodamine B | 60 g |
| | Tetrahydrofuran | 2800 g |
| | N,N-dimethylformamide | 1000 g |
| No. 4 | | |
| | Olester F77-60MS (Oil-modified polyurethane manufactured by MITSUI TOATSU KAGAKU K.K.) (solid content) | 400 g |
| | Rhodamine 6G | 80 g |
| | Mineral spirit | 3600 g |
| | Cobalt naphthenate | 0.04 g |
| | Lead naphthenate | 0.4 g |
| No. 5 | In place of the Crystal Violet of No. 1 composition were employed 4 grams of Ketjen Black EC (carbon black manufactured by Degussa Company). | |
| No. 6 | In place of the Brilliant Green of No. 2 composition was employed 0.4 gram of Ketjen Black EC. | |
| No. 7 | In place of the Rhodamine B of No. 3 composition were employed 16 grams of aluminum powder. | |
| No. 8 | In place of the Rhodamine 6G of No. 4 composition were employed 20 grams of aluminum power. | |

The above-mentioned 8 varieties of coating solutions were respectively applied onto a photosensitive layer so as to give a film about 2μthick. Thus, photosensitive materials were prepared, Nos. 1 to 4 being the materials according to the present invention and Nos. 5 to 8 being controls. These photosensitive materials were each measured with reference to the ability to retain a charged electric potential. The results thus obtained are as shown in Table-1. It was observed therefrom that the photosensitive materials of the present invention were superior in the ability to retain a charged electric potential.

In this connection, moreover, it was also observed that the residual electric potential was less than 5 V in each of Nos. 1 to 8 photosensitive materials. In this regard it is mentioned that by the term "residual electric potential" used herein is meant a charged electric potential after the charged potential 1000 V has been light-decayed under the conditions: the exposure amount 50 lux.sec., the exposure time 30 seconds.

Table - 1

| No. | Photosensitive layer | Ability to retain* charged electric potential (%) |
|---|---|---|
| 1 | A | 82 |
| 2 | B | 76 |
| 3 | B | 73 |
| 4 | C | 79 |
| 5 | A | 38 |
| 6 | B | 46 |
| 7 | B | 51 |
| 8 | C | 45 |

*Ability to retain charged electric potential $$= \frac{\text{Charged potential after 1000 V has been dark-decayed for 20 seconds}}{1000\ \text{V}} \times 100$$

EXAMPLE 2

The following Nos. 9 to 12 coating solutions for use in the formation of protective layers were prepared miling the same compositions as in Example 1. In this connection, however, it is mentioned that in the case of No. 12 only mixing and stirring were conducted with exception of ball-milling.

| | | |
|---|---|---|
| No. 9 | | |
| | HSP | 400 g |
| | p-chloranil | 18 g |
| | Crystal Violet | 8 g |
| | Tetrahydrofuran | 2400 g |
| No. 10 | | |
| | Paraprene pellet 27 SM | 400 g |
| | 2,4,7-trinitrofluorenone | 2 g |
| | Brilliant Green | 0.1 g |
| | Tetrahydrofuran | 2400 g |
| | N,N-dimethylformamide | 1200 g |
| No. 11 | | |
| | U polymer | 200 g |
| | 7,7,8,8-tetracyanoquinodimethane | 10 g |
| | Rhodamine B | 10 g |
| | Tetrahydrofuran | 2800 g |
| | N,N-dimethylformamide | 1000 g |
| No. 12 | | |
| | Olester F77-60MS | 400 g |
| | 2,6-dicyano-p-benzoquinone | 16 g |
| | Rhodamine 6G | 16 g |
| | Mineral spirit | 3600 g |
| | Cobalt naphthenate | 0.04 g |
| | Lead naphthenate | 0.4 g |

The above-mentioned 4 varieties of coating solutions were respectively applied onto the photosensitive layer according to Example 1 so as to give a thin film about 2μthick, whereby there were prepared the photosensitive materials of the present invention. These materials were measured with respect to the ability to retain a charged electric potential. The results thus obtained are as shown in Table-2. It was observed therefrom that the photosensitive materials comprising the simultaneous addition of an electron acceptable substance (electron affinity substance) could exhibit a superior effect even in conditions of high humidity.

Table 2

| No. | Photosensitive layer | Ability to retain electric potential at 21° C., 60% RH (%) | | Ability to retain electric potential at 30° C., 90% RH (%) | |
|---|---|---|---|---|---|
| | | non-added** | added*** | non-added** | added*** |
| 9 | A | 80 | 80 | 32 | 72 |
| 10 | B | 86 | 86 | 44 | 71 |
| 11 | B | 77 | 80 | 68 | 79 |
| 12 | C | 76 | 78 | 52 | 70 |

**denotes a photosensitive material to which no electron affinity substance added.
***denotes a photosensitive material to which an electron affinity substance added.

EXAMPLE 3

Photosensitive materials Nos. 13 to 24 were prepared by coating the photosensitive layer B with the respective solutions obtained from the coating solution No. 3 except that the Rhodamine B used therein was replaced by the following components. The thus prepared photosensitive materials were measured with respect of the ability to retain an charged electric potential.

Organic compound having the structure according to the formula

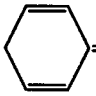
$=N^{\oplus}$ in the molecule:

1. Rhodamine B Lake
2. Sulpho Rhodamine B
3. Ethyl Violet
4. Methyl Violet
5. Malachite Green oxalate
6. Pyronine B
7. Malachite Green Electron acceptor (Electron acceptable substance):

1. Tetracyanoethylene
2. o-chloranil
3. 2,6-dicyano-p-benzoquinone
4. 2,3-dichloro-5,6-dicyano-p-benzoquinone
5. Tetracyano-p-benzoquinodimethane
6. o-bromanil Table - 3

| No. | Amount added to U polymer: Organic compound of the structure of 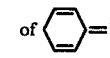 $=N^{\oplus}$ | (wt. %) | Acceptor | (wt. %) | Ability to retain charged electric potential (%): 20° C., 60% RH | 30° C., 90% RH |
|---|---|---|---|---|---|---|
| 13 | 1 | 10 | | — | 82 | 21 |
| 14 | 2 | 5 | | — | 83 | 33 |
| 15 | 3 | 5 | | — | 79 | 20 |
| 16 | 4 | 5 | | — | 90 | 45 |
| 17 | 5 | 2 | | — | 85 | 50 |
| 18 | 6 | 10 | | — | 78 | 34 |
| 19 | 1 | 10 | 1 | 5 | 82 | 77 |
| 20 | 3 | 5 | 2 | 5 | 84 | 70 |
| 21 | 4 | 5 | 3 | 7 | 80 | 75 |

Table - 3-continued

| | Amount added to U polymer | | | | Ability to retain charged electric potential (%) | |
|---|---|---|---|---|---|---|
| | Organic compound of the structure | | | | | |
| No. | of 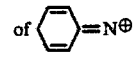 | (wt. %) | Accep-tor | (wt. %) | 20° C., 60% RH | 30° C., 90% RH |
| 22 | 5 | 2 | 4 | 10 | 85 | 77 |
| 23 | 6 | 2 | 5 | 10 | 90 | 86 |
| 24 | 7 | 2 | 6 | 10 | 89 | 80 |

What is claimed is:

1. An electrophotographic element, comprising:

an electrically conductive support;

a photoconductive layer superposed on said support, said photoconductive layer consisting essentially of an inorganic photoconductor or a non-dyestuff organic photoconductor;

a protective layer superposed on said photoconductive layer, said protective layer consisting of a non-photoconductive binder resin and from 0.1 to 30% by weight of one or a mixture of organic compounds containing the moiety

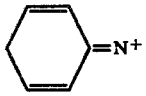

in the molecule, said protective layer having a thickness in the range of 0.5 to 5 μm and being thinner than said photoconductive layer, whereby said electrophotographic element exhibits a low residual electric potential after exposure to light and it retains a high proportion of an initial electric charge while it is maintained in the dark.

2. An electrophotographic element according to claim 1 in which said photoconductive layer consists of photoconductive selenium.

3. An electrophotographic material according to claim 1 or claim 2 wherein said organic compound is selected from the group consisting of Rhodamine B, Rhodamine 6G, Rhodamine 110, Rhodamine B Lake, Rhodamine 6G Lake, Rhodamine 6G Perchloride, Sulpho Rhodamine B, Crystal Violet, Ethyl Violet, Methyl Violet, Brillant Green, Malachite Green oxalate, Pryonine B, Diamond Green and Malachite Green.

4. An electrophotographic material according to claim 1 wherein the amount of said organic compound in said protective layer is in the range of from about 1 to 10% by weight.

5. An electrophotographic element according to claim 1 wherein said binder resin is selected from the group consisting of polystyrene, acrylic resin, vinyl chloride-vinyl acetate copolymer, polyurethane resin and cellulosic resin.

6. An electrophotographic element, comprising:

an electrically conductive support;

a photoconductive layer superposed on said support, said photoconductive layer consisting essentially of an inorganic photoconductor or a non-dyestuff organic photoconductor;

a protective layer superposed on said photocondutive layer, said protective layer consisting of a non-photoconductive binder resin, from 0.1 to 30% by weight of one or a mixture of organic compounds containing the moiety

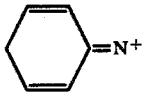

in the molecule and from 0.1 to 30% by weight of one or a mixture of electron acceptors, said protective layer having a thickness in the range of 0.5 to 5 μm and being thinner than said photoconductive layer, whereby said electrophotographic element exhibits a low residual electric potential after exposure to light and it retains a high proportion of an initial electric charge while it is maintained in the dark under high humidity.

7. An electrophotographic element according to claim 3 in which said photoconductive layer consists of photoconductive selenium.

8. An electrophotographic material according to claim 6 or claim 7 wherein the organic compound is selected from the group consisting of Rhodamine B, Rhodamine 6G, Rhodamine 110, Rhodamine B Lake, Rhodamine 6G Lake, Rhodamine 6G Perchloride, Sulpho Rhodamine B, Crystal Violet, Ethyl Violet, Methyl Violet, Brillant Green, Malachite Green oxalate, Pyronine B, Diamond Green and Malachite Green and wherein said electron acceptor substance is one or a mixture of at least two members selected from the group consisting of 7,7,8,8-tetracyanoquinodimethane, tetracyanoethylene, 2,4,7-trinitrofluorenone, o-chloranil, 2,5-dichloro-p-benzoquinone, 2,3-dichloro-5,6-dicyano-p-benzoquinone, 2,6-dicyano-p-benzoquinone, tetracyano-p-benzoquinodimethane, o-bromanil, p-chloranil, trichloro-p-benzoquinone, 2,6-dichloro-p-benzoquinone, 2,5-dichloro-p-benzoquinone and 2,3-dichloro-p-benzoquinone.

9. An electrophotographic material according to claim 6 wherein the amount of said compound in said protective layer is in the range of from about 1 to 10% by weight and the amount of said electron acceptor substance in said protective layer is in the range of from about 1 to 10% by weight.

10. An electrophotographic element according to claim 6 wherein said binder resin is selected from the group consisting of polystyrene, acrylic resin, vinyl chloride-vinyl acetate copolymer, polyurethane resin and cellulosic resin.

* * * * *

UNITED STATES PATENT AND TRADEMARK OFFICE

CERTIFICATE OF CORRECTION

PATENT NO. : 4 191 568

DATED : March 4, 1980

INVENTOR(S) : Hideaki Ema et al

It is certified that error appears in the above-identified patent and that said Letters Patent are hereby corrected as shown below:

Column 9, line 48; change "Brillant" to ---Brilliant---.

Column 9, line 48; change "Pryo" to ---Pyro---.

Column 10, line 12; change "photocondutive" to ---photoconductive---.

Column 10, line 41; change "Brillant" to ---Brilliant---.

Signed and Sealed this

*Tenth* Day of *June 1980*

[SEAL]

*Attest:*

SIDNEY A. DIAMOND

*Attesting Officer*

*Commissioner of Patents and Trademarks*